US006634510B2

(12) United States Patent
Larson et al.

(10) Patent No.: US 6,634,510 B2
(45) Date of Patent: Oct. 21, 2003

(54) DISHWASHER RACK EXTENDER HAVING CONNECTOR PINS

(75) Inventors: Lawrence L. Larson, Lodi, WI (US); Daniel P. Pesik, Lodi, WI (US)

(73) Assignee: Traex Company, Toledo, OH (US)

( * ) Notice: Subject to any disclaimer, the term of this patent is extended or adjusted under 35 U.S.C. 154(b) by 0 days.

(21) Appl. No.: 10/106,474

(22) Filed: Mar. 25, 2002

(65) Prior Publication Data

US 2003/0178378 A1 Sep. 25, 2003

(51) Int. Cl.[7] ..... A47G 19/08

(52) U.S. Cl. ..... 211/41.8; 411/509; 403/329; 211/126.12; 211/183; 211/41.9

(58) Field of Search ..... 211/41.8, 41.9, 211/126.1, 126.2, 126.3, 126.12, 194, 41.2, 41.3, 184, 183; D32/55; 206/503, 504, 509, 511, 512, 557, 558, 821; 108/53.1, 91; 248/222.11, 222.12; 220/4.26, 4.03; 403/326, 329, 321; 24/572.1, 581.1, 458, 453, 297, 324; 411/913, 508–510

(56) References Cited

U.S. PATENT DOCUMENTS 3,954,184 A * 5/1976 Mendenhall ..... 211/184
4,284,603 A * 8/1981 Korom ..... 422/101
4,316,677 A * 2/1982 Ciavatta ..... 411/520
4,353,470 A * 10/1982 Polhemus et al. ..... 211/126.12
4,572,368 A * 2/1986 Miller et al. ..... 206/708
4,664,283 A * 5/1987 Liu ..... 220/4.28
4,723,679 A * 2/1988 Sinchok et al. ..... 220/4.03
4,895,256 A * 1/1990 Johnston ..... 206/501
5,113,553 A * 5/1992 Hutchinson ..... 24/464
5,328,046 A * 7/1994 Kutz et al. ..... 220/266
5,520,410 A * 5/1996 Sun ..... 24/587
5,544,751 A * 8/1996 Klodt et al. ..... 206/509
5,735,024 A * 4/1998 Orttz ..... 24/575
5,829,722 A * 11/1998 Igarashi et al. ..... 248/222.12
5,934,486 A * 8/1999 Jarvis et al. ..... 211/41.8
6,098,819 A * 8/2000 Link ..... 211/85.13
6,105,215 A * 8/2000 Lee ..... 24/458
6,280,116 B1 * 8/2001 Szu ..... 403/408.1
6,305,055 B1 * 10/2001 Castro ..... 24/458

FOREIGN PATENT DOCUMENTS

GB 826507 * 1/1960 ..... 211/126.2

OTHER PUBLICATIONS

Aplicant's Exhibit A side view of prior art dishwashing rack pin: Document # 4. Detail B.

* cited by examiner

*Primary Examiner*—Daniel P. Stodola
*Assistant Examiner*—Jennifer E. Novosad
(74) *Attorney, Agent, or Firm*—Emch, Schaffer, Schaub & Porcello Co., L.P.A.

(57) ABSTRACT

A glass and cup holding assembly for an automatic dishwasher includes a rack and a rack extender. The rack has side walls with an upper edge having spaced apart upwardly opening sockets. The rack extender has side walls with a lower edge defining connector pins each having a shaft, at least a portion of which tapers inwardly from the lower edge, and an enlarged head defining a catch surface. The pins engage the sockets such that the shaft is disposed within the socket and the head catch surface engages an underside of the upper edge of the side wall.

12 Claims, 5 Drawing Sheets

DISHWASHER RACK EXTENDER HAVING CONNECTOR PINS

CROSS-REFERENCE TO RELATED APPLICATION

Not applicable.

STATEMENT OF FEDERALLY SPONSORED RESEARCH OR DEVELOPMENT

Not applicable.

FIELD OF THE INVENTION

This invention relates to racks for cups and glasses that are used in commercial automatic dishwashers.

BACKGROUND OF THE INVENTION

It is common in the restaurant and food service industry to use automatic dishwashers for cups and glasses which accept a standard dishwasher rack that is approximately 20"×20" square. Different racks are used with different size compartments to most closely match the diameter of the glasses or cups being washed. For tall items, extenders having the same number of compartments are stacked on top of the rack, as is well known in the industry. It is also common to increase wall height by stacking multiple extenders together.

Extenders are joined to the base racks by pin and socket connections along their perimeters. More specifically, each extender has downwardly extending pins at the bottom that fit inside upwardly opening sockets at the top of an adjacent rack or extender. The pins of the adjacent extender align with and fit into the openings in the sockets in the adjacent lower rack or extender, thereby rigidly connecting each piece to create a solid stack. This pin and socket connection is advantageous because the pins and sockets can be formed integrally with the ordinarily injection molded plastic racks and extenders during molding such that separate hardware is not needed.

A significant problem with this technique, however, is shearing of the pins. This can result in damage not only to the stack but the glassware contained therein. To reduce or prevent this occurrence, current practice is to select a high grade plastic resin with good strength characteristics. Of course, this resin is more expensive than lesser grades, and because the pins and sockets are molded as one with the rest of the racks and extenders, this increases the cost considerably.

SUMMARY OF THE INVENTION

The invention provides an improved rack extender with a high strength pin construction for connection to a rack used to hold glasses or cups in an automatic dishwasher. Specifically, the extender has a rectilinear frame with four side walls defining a first perimeter edge and a second perimeter edge. The frame includes connector pins spaced apart along and extending from the first edge substantially perpendicularly to the plane defined by the frame. Each pin has a shaft, at least a portion of which tapers inwardly from the first edge, and an enlarged head defining a catch surface. Sockets are spaced apart along the second edge of the frame in alignment with the pins. Each socket opens upwardly in the upper edge of the frame and is sized to receive the shaft and engage the catch surface of a pin.

In one preferred form, the pins are at a bottom side of the frame and the sockets are at the top side of the frame. Also, the frame is square and has four pins and four sockets at each side wall. Each pin shaft has a non-tapered portion between the taper and the head. The head of each pin is tapered and defines an elliptical arc that sweeps 180 degrees.

The improved extender can also have a compartment grid spanning the frame to define openings sized to accommodate the glasses and cups.

The invention also provides an automatic dishwasher rack and rack extender assembly. The rack has side walls with an upper edge having spaced apart upwardly opening sockets. The extender has side walls with a lower edge defining connector pins each having a shaft, at least a portion of which tapers inwardly from the lower edge, and an enlarged head defining a catch surface. The extender is connected to the rack by inserting the pins into the sockets in the rack such that the shaft is disposed within the socket and the head catch surface engages an underside of the upper edge of the side wall.

Other objects and advantages of the invention will be apparent from the detailed description and drawings.

DETAILED DESCRIPTION OF THE PREFERRED EMBODIMENT

Figure 1:
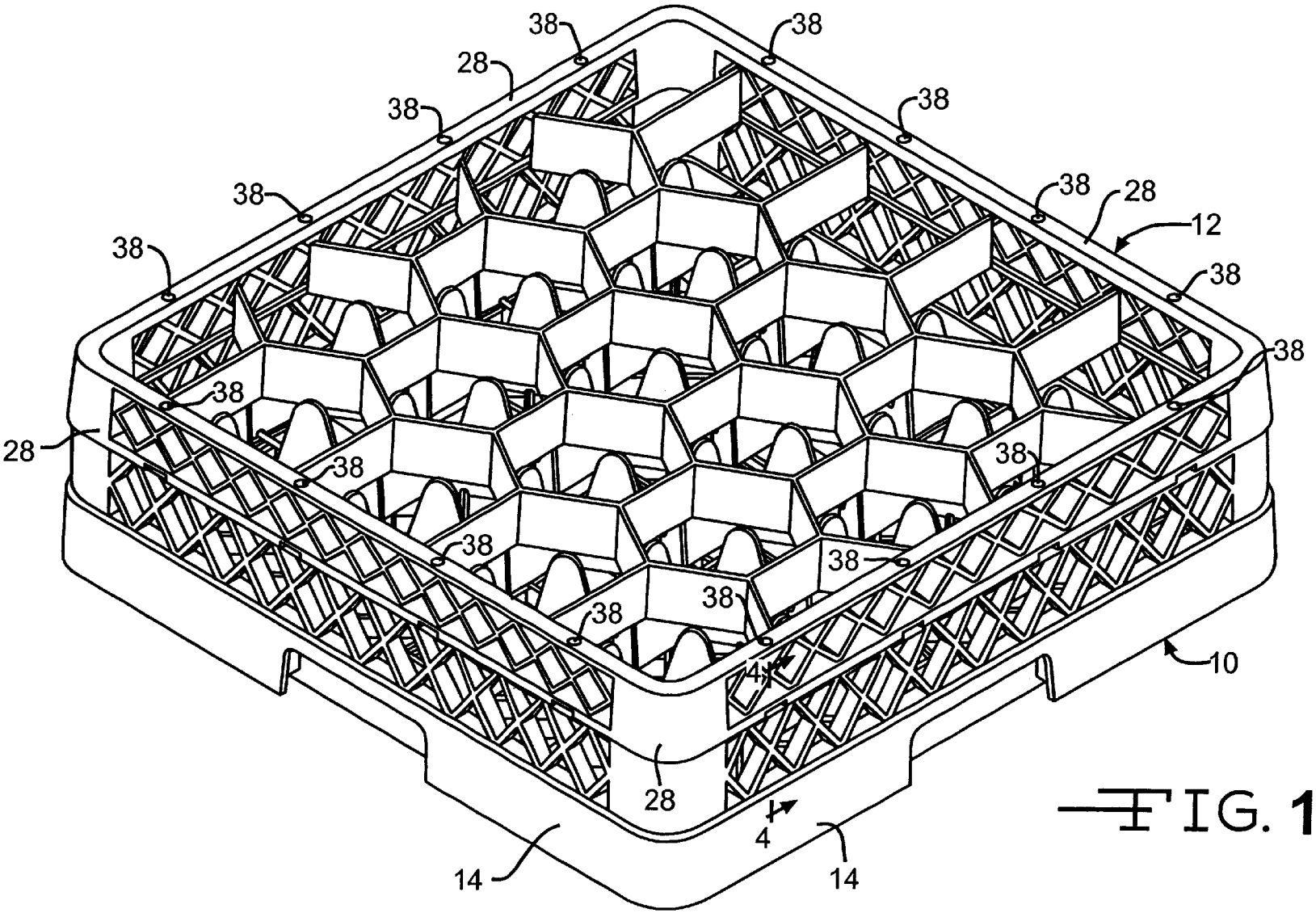
FIG. 1 is a perspective view of a dishwasher rack and rack extender assembly incorporating the invention
Figure 2:
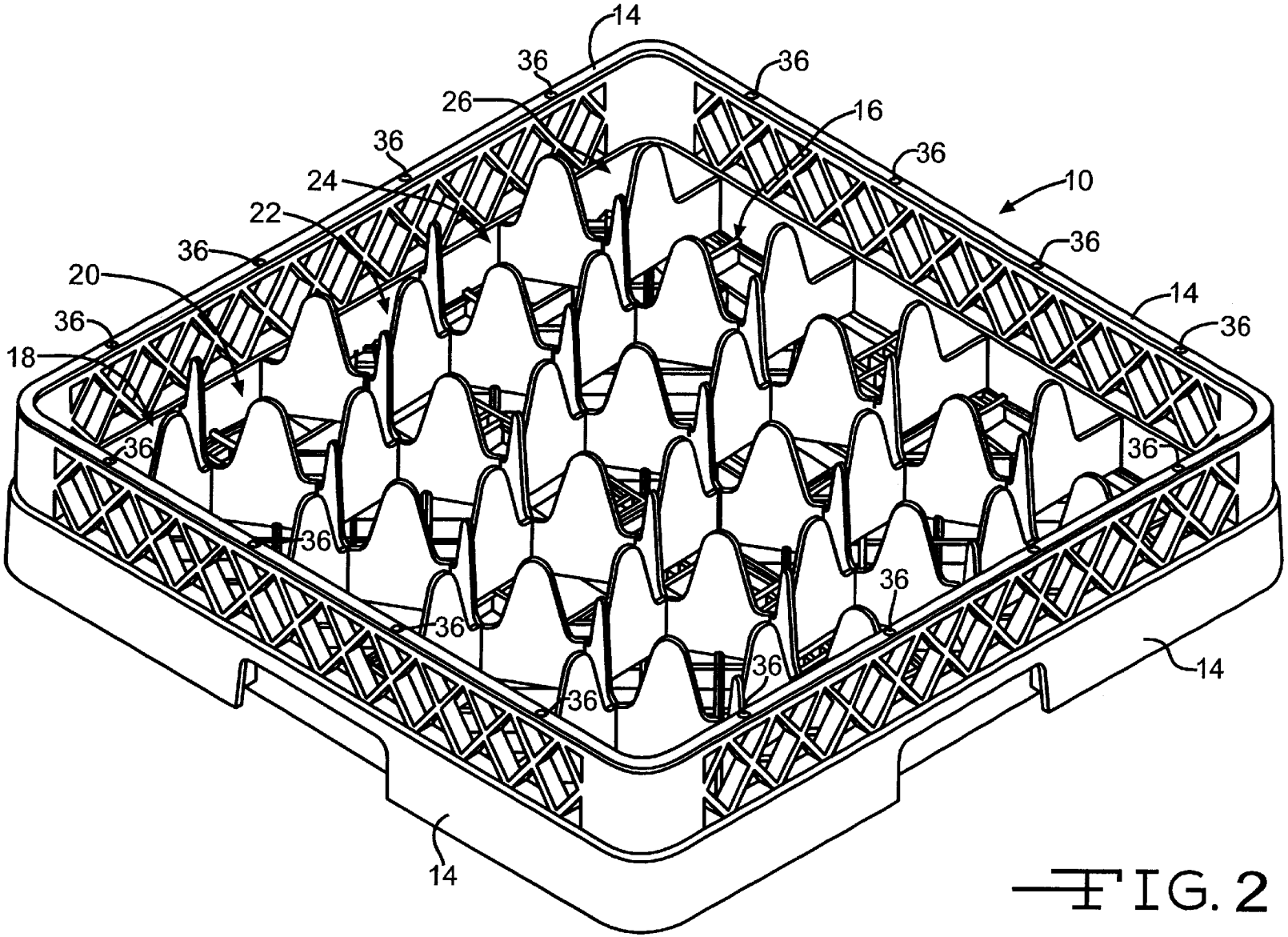
FIG. 2 is a perspective view of the dishwasher rack of FIG. 1.

Referring to FIG. 1, a dishwasher rack 10 and rack extender 12 assembly of the invention is of typical construction except for the construction of the connector pins. Thus, referring to FIG. 2, the rack 10 has a typical frame made of four side walls 14, which are arranged in a square shape in standard dimensions (19.72"×19.72" for example) and are open at the top. The lower portion of the rack 10 is defined by a standard open grid 16, as is conventional, that supports the glasses and cups when they are in the compartments. The compartments have paddle shaped walls that extend higher in the center thereof than at the ends so as to protect glasses placed in the compartments and yet permit water flow through a substantial portion of the dividers.

The compartment grid 16 is molded integral with the side walls 14 and preferably includes five rows 18, 20, 22, 24 and 26 as illustrated. The middle three rows 20, 22 and 24 are each made up of four hexagonal compartments and a half hexagonal compartment, with the half hexagonal compartments alternating in the end they are on from one row to the adjacent row. The compartments of the adjacent rows are nested with one another, so that adjacent compartments share a wall. Each of the rows 18 and 26 include four pentagonal compartments which are nested with the adjacent hexagonal compartments of the respective rows 20 and 24 so that adjacent compartments share a wall. Each of the rows 18 and 26 also have a half pentagonal compartment at one end. This configuration results in 20 full size compartments, each of which is able to hold a glass or cup which is 3.93" in diameter or less. Smaller cups or glasses could also be placed in the half compartments, if practical. The present invention could be practiced with racks having any number and shape of compartments.

Figure 3:
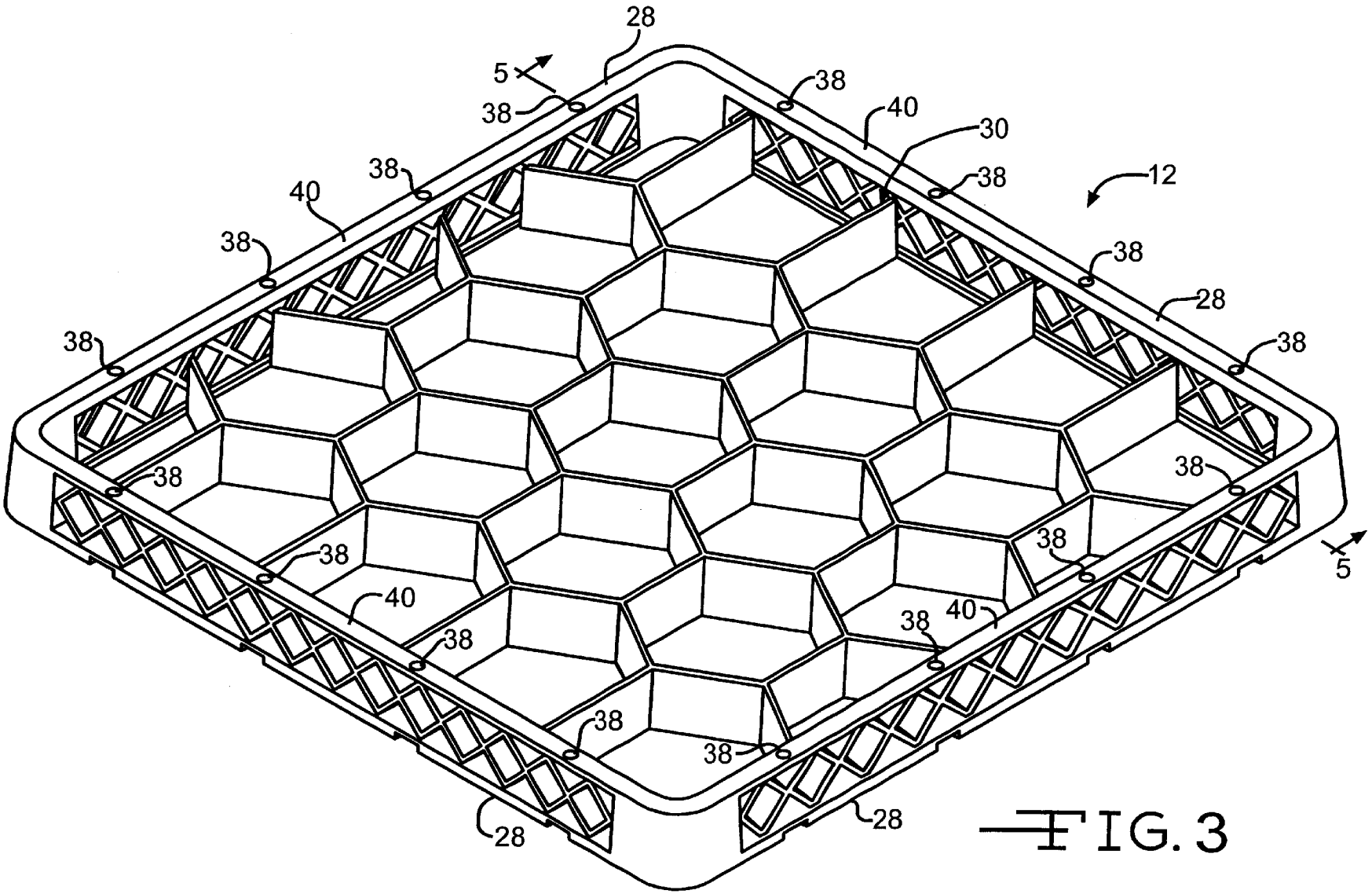
FIG. 3 is a perspective view of the rack extender of FIG. 1.
Figure 5:
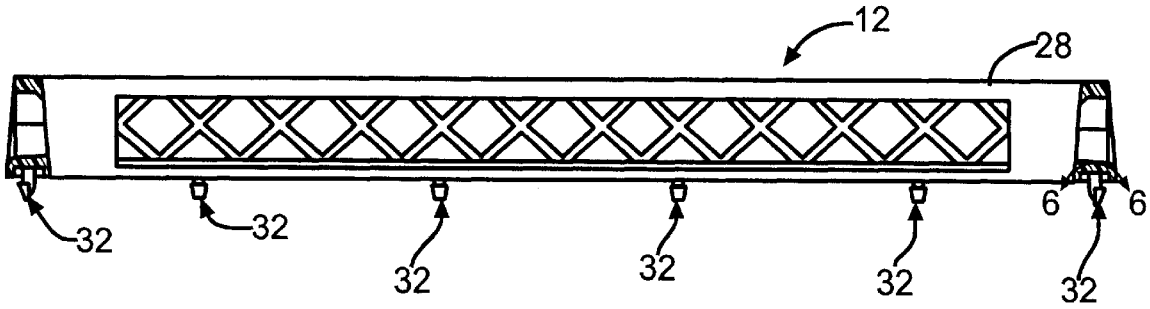
FIG. 5 is a cross-sectional view through line 5—5 of FIG. 3 of the rack extender without a compartment grid.
Figure 6:
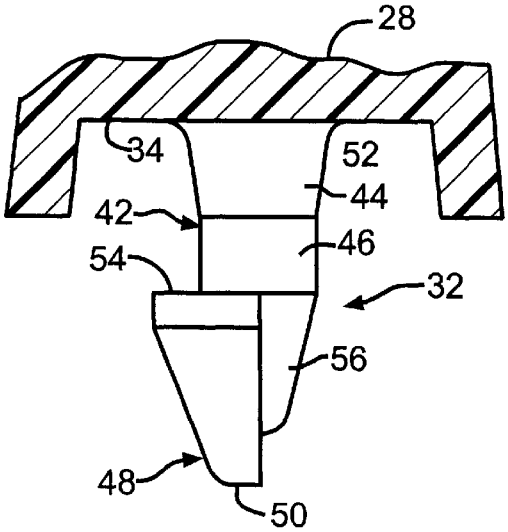
FIG. 6 is an enlarged detail view along arc 6—6 of FIG. 5 showing one pin structure of the invention.
Figure 7:
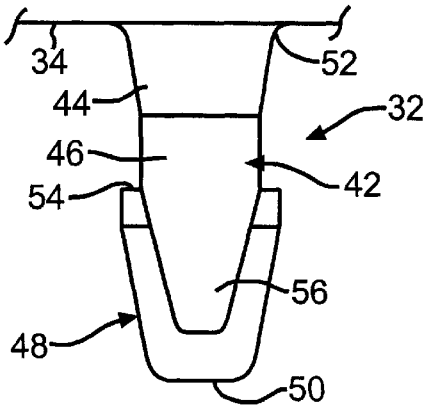
FIG. 7 is a side view of the pin structure as shown in FIG. 6.
Figure 8:
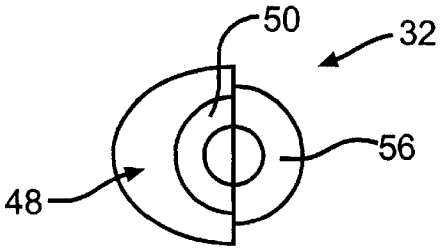
FIG. 8 is a bottom view of the pin structure as shown in FIG. 6.

Referring to FIGS. 3 and 5, the rack extender 12 has a frame made of four side walls 28, which are arranged in a square shape in standard dimensions and are open at the top and bottom. A compartment grid 30 can extend between the frame of the extender to define compartments aligned with the compartments of the rack 10. For taller cups and glasses, as is conventional, one or more extenders are provided. The extender 12 has pins 32 extending downwardly from bottom edge surface 34 of its side walls 28 which fit into corresponding sockets 36 in the tops of the side walls 14 of the rack 10 (see FIG. 2). The extender 12 also has sockets 38 in the top edge surfaces 40 of its side walls 28 to receive the pins of an adjacent additional extender if necessary. Preferably, each extender has four pins 32 spaced apart along and extending downwardly form the bottom edge 34 of each side wall 28 for a total of sixteen pins 32 per extender 12. The rack 10 has a corresponding number of sockets 36 as do the top edges 40 of the extender 12.

Referring to FIGS. 4 and 6–8, the pins 32 have a shaft 42 with a tapered base 44 and a cylindrical middle 46 that extends between the tapered base 44 and an enlarged head 48. The tapered base 44 is generally frusto-conical in shape, tapering downwardly from the side wall 28 to the middle 46 section of the pin shaft 42. The pins 32 are preferably molded integrally with the side walls 28 and meet the bottom edge 34 at a radius 52. The taper and the radius strengthen the pins and significantly reduce shearing of the pins when connected to the rack 10. The head 48 of the pin 32 is a semi-ellipsoidal shape that sweeps an elliptical arc of 180 degrees in vertical cross-section (see FIG. 8) and tapers outward from its leading end 50 to a catch edge 54 extending outwardly from the middle 46 section of the shaft 42. The other half of the head 48 is a tapered conical section 56 of reduced dimension that extends axially from the middle 46 section of the shaft.

Figure 4:
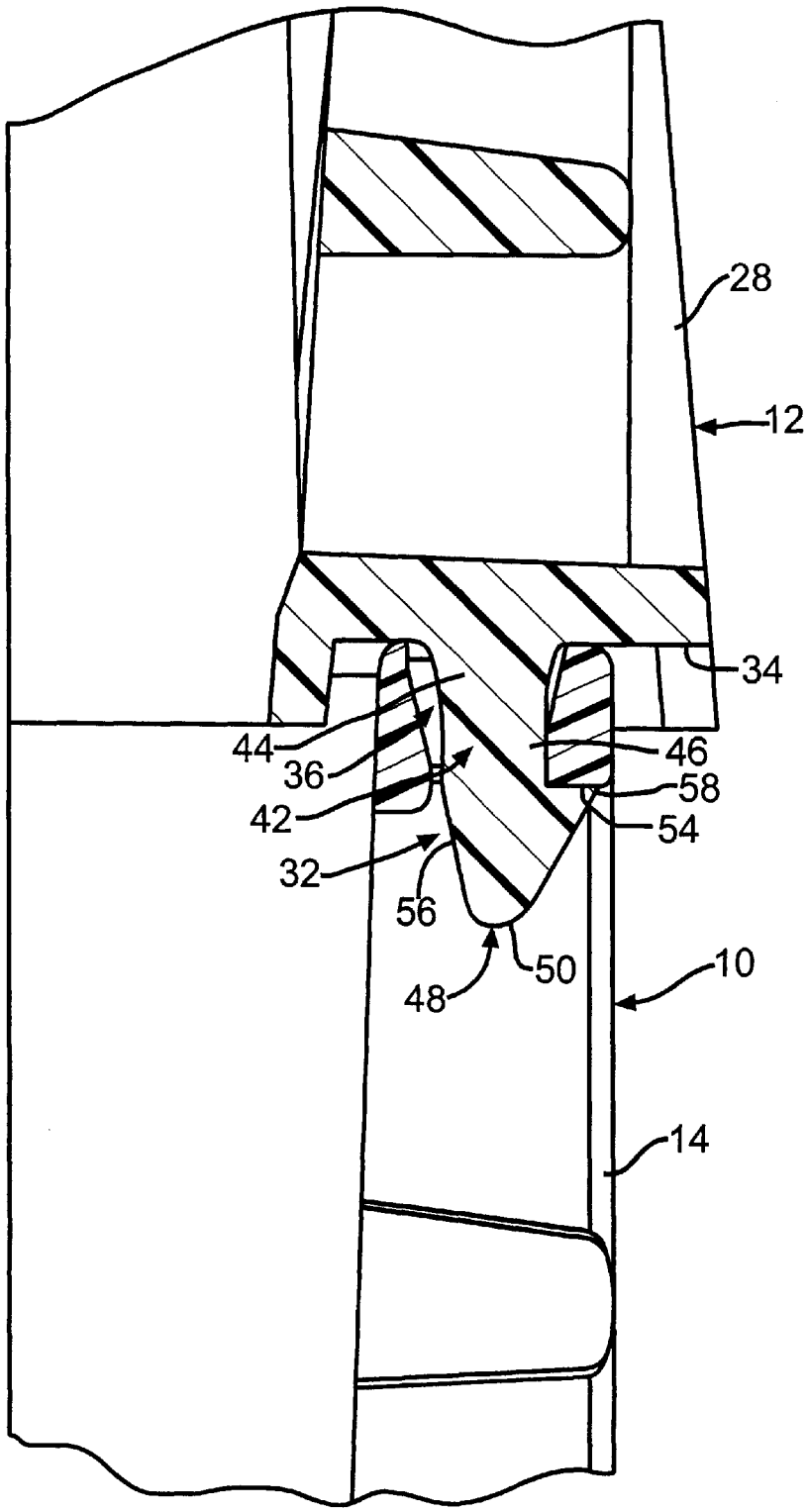
FIG. 4 is a cross-section view through line 4—4 of FIG. 1.

Referring to FIG. 4, the sockets 38 in the rack 10 taper inwardly from top to bottom and define a lower ledge 58 that the catch 54 of the pin head 48 engages. Since the enlarged portions of the heads 48 extend only 180 degrees, the heads 48 can be pressed into and through the sockets 38 (which flex outwardly during insertion) so that the catches 54 permanently engage the lower ledges 58 of the rack 10.

In a preferred form, the dish rack and extender of the invention are made of injection molded plastic. For example, a polypropylene copolymer is a suitable material for the rack and extender.

A preferred embodiment of the invention has been disclosed and described. Many modifications and variations to the preferred embodiment described will be apparent to those skilled in the art. Therefore, the invention should not be limited to the embodiment described, but should be defined by the claims which follow.

We claim:

1. A rack extender for a rack used to hold glasses or cups in an automatic dishwasher, the extender having a rectilinear frame with four side walls defining a first perimeter edge and a second perimeter edge, wherein the frame further includes:

connector pins spaced apart along and extending from the first edge substantially perpendicularly to the plane defined by the frame, each pin having a shaft, having a tapered base, a cylindrical middle section and an enlarged head, the tapered hose having a generally frusto-conical shape tapering downwardly from the first edge to the middle section, the head having a generally semi-ellipsoidal shape defined by an elliptical arc, the head having a leading end and a catch edge extending outwardly from the middle section of the shaft, the leading end tapering to the catch edge.

2. The rack extender of claim 1, wherein the frame further includes sockets spaced apart along the second edge of the frame in vertical alignment with the pins, each socket opening upwardly in an upper edge of the frame and sized to receive the shaft and engage the catch edge of a pin of an adjacent rack extender.

3. The rack extender of claim 2, further including a compartment grid spanning the frame and defining openings sized to accommodate the glasses or cups.

4. The rack extender of claim 2, wherein the first edge is at a bottom side of the frame and the second edge is at a top side of the frame.

5. The rack extender of claim 4, wherein the frame is square and includes four pins and four sockets at each side wall.

6. The rack extender of claim 4, wherein each pin shaft has a non-tapered portion between the tapered base and the head.

7. The rack extender of claim 1, wherein the elliptical arc is 180 degrees.

8. An automatic dishwasher rack and rack extender assembly having frames and open grids within side walls and forming an array of compartments for holding glasses and cups, the assembly comprising:

a rack with side walls having an upper edge with spaced apart upwardly opening sockets; and an extender having side walls having a lower edge defining connector pins each having a shaft, having a tapered base, a cylindrical middle section and an enlarged head, the tapered base having a generally frusto-conical shape tapering downwardly from the lower edge to the middle section, the head having a generally semi-ellipsoidal shape defined by an elliptical arc, the head having a lending end and a catch edge extending outwardly from the middle section of the shaft, the leading end tapering to the catch edge, wherein the pins engage the sockets such that the shaft is disposed within the socket and the catch edge engages an underside of the upper edge of the side wall.

9. The assembly of claim 8, wherein the side walls of the extender have an upper edge defining spaced apart upwardly extending sockets aligned vertically with the pins.

10. The assembly of claim 9, wherein the extender includes four side walls defining a square wherein each of said side walls includes four pins.

11. The assembly of claim 10, wherein each pin shaft has a non-tapered portion between the tapered base and the head.

12. The assembly of claim 8, is wherein the elliptical arc is 180 degrees.

* * * * *

UNITED STATES PATENT AND TRADEMARK OFFICE

CERTIFICATE OF CORRECTION

PATENT NO. : 6,634,510 B2 
DATED : October 21, 2003
INVENTOR(S) : Lawrence L. Larson and Daniel P. Pesik It is certified that error appears in the above-identified patent and that said Letters Patent is hereby corrected as shown below:

Column 4,
Line 50, delete "lending" and insert -- leading --.
Line 64, delete "is".

Signed and Sealed this

Twenty-seventh Day of January, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,634,510 B2 
DATED : October 21, 2003
INVENTOR(S) : Lawrence L. Larson and Daniel P. Pesik It is certified that error appears in the above-identified patent and that said Letters Patent is hereby corrected as shown below:

Column 4,
Line 8, the word "hose" should be replaced with -- base --.

Signed and Sealed this

Fourth Day of May, 2004

JON W. DUDAS
*Acting Director of the United States Patent and Trademark Office*